United States Patent [19]

Budzich

[11] Patent Number: 4,798,126

[45] Date of Patent: Jan. 17, 1989

[54] LOAD RESPONSIVE SYSTEM USING LOAD RESPONSIVE PUMP CONTROL OF A BYPASS TYPE

[75] Inventor: Tadeusz Budzich, Moreland Hills, Ohio

[73] Assignee: Caterpillar Inc., Peoria, Ill.

[21] Appl. No.: 29,001

[22] Filed: Mar. 23, 1987

[51] Int. Cl.[4] ..... F15B 13/02

[52] U.S. Cl. ..... 91/518; 91/451; 137/596.13; 137/596.15; 137/596.16; 137/596.17

[58] Field of Search ..... 91/451, 518; 137/596.13, 596.15, 596.16, 596.17

[56] References Cited

U.S. PATENT DOCUMENTS

| | | | |
|---|---|---|---|
| 3,488,953 | 1/1970 | Haussler . | |
| 3,631,890 | 1/1972 | McMillen | 137/596.13 |
| 3,882,896 | 5/1975 | Budzich | 137/596.1 |
| 4,159,724 | 7/1979 | Budzich | 137/596.13 |
| 4,282,898 | 8/1981 | Harmon et al. | 137/596.13 |
| 4,303,091 | 12/1981 | Hertell et al. | 137/596.13 X |
| 4,574,838 | 3/1986 | Manttari et al. | 137/596.17 X |

*Primary Examiner*—Gerald A. Michalsky
*Attorney, Agent, or Firm*—J. W. Burrows

[57] ABSTRACT

A load responsive system having at least one direction and flow control valve, the flow control of which is accomplished in response to a control signal above a certain predetermined pressure level and a fixed displacement pump, provided with a bypass type output flow control, operable to maintain a constant pressure differential between pump discharge pressure and load pressure of the load controlled by the direction and flow control valve. The output flow control is provided with an unloading control, which maintains the discharge pressure of the pump at any preselected minimum pressure level once the control signal transmitted to the direction and flow control valve drops below a certain minimum predetermined pressure level signifying that the system is in standby condition.

18 Claims, 5 Drawing Sheets

LOAD RESPONSIVE SYSTEM USING LOAD RESPONSIVE PUMP CONTROL OF A BYPASS TYPE

BACKGROUND OF THE INVENTION

This invention generally relates to bypass type flow control of a fixed displacement pump used in a load responsive system.

In more particular aspects this invention relates to unloading controls of a pump bypass type control for use in load responsive systems.

In still more particular aspects this invention relates to unloading controls for load responsive bypass type pump controls, which reduce the pump discharge pressure below the level of the control pressure differential, when the control system is maintained in a standby condition.

Load responsive controls of pump output flow are widely used and are very desirable in load responsive systems, since they improve the system efficiency and the control characteristics of the system valves. Such a load responsive pump control of a bypass type is shown in U.S. Pat. No. 3,488,953, issued to Haussler. When using such a control the minimum pump discharge pressure, even in standby condition, is dictated by the value of the control pressure differential, which may be in the order of say 200 PSI and especially with large pumps represents a high energy loss, with the system in standby condition.

The efficiency of such a control can be increased by providing an unloading control, which permits reduction in the pump discharge pressure in the standby condition to a level, below that equivalent to the control pressure differential. Such a control is shown in my U.S. Pat. No. 3,882,896, issued May 13, 1975 and also in my U.S. Pat. No. 4,159,724, issued Jul. 3, 1979. Those unloading controls although very effective suffer from one basic disadvantage. Since deactivation of the unloading control is accomplished by the load pressure signal and since the system may be controlling very small loads, the pump discharge pressure, in its standby condition, can only be reduced to a pressure level, which will provide sufficient energy for deactivation of the unloading control. This minimum pressure level, although lower than the control pressure differential, must still be of sufficient magnitude, so that it still represents a very significant loss in standby condition. Also there is an additional disadvantage to this approach and that is the comparatively slow response of the unloading control, in activation of the load responsive control of the pump. This feature becomes especially important when the controlled load may reverse direction and therefore from being of positive type becomes of a negative type. Under these conditions, during negative load control, the unloading control becomes activated, adversely affecting the response characteristics of the control system operating such a load.

SUMMARY OF THE INVENTION

It is therefore a principal object of this invention to provide unloading controls of a load responsive output pump control of a bypass type, which can unload the minimum pump discharge pressure virtually to atmospheric level, while the response of the system controls is not affected.

It is another object of this invention to provide unloading controls of a load responsive flow output pump control of a bypass type, which responds to the control signals transmitted to the direction and flow control valve of the system, below a certain specific energy level of such control signals.

It is another object of this invention to provide an unloading control of a load responsive bypass type pump control, which utilizes for its operation the energy derived from a source other than the system pump being controlled.

It is another object of this invention to provide an unloading control of a load responsive bypass type pump control, which is responsive to the control signals to position the direction control valves of the system and which permits deactivation of the unloading control, before the direction control spools of the system are displaced from their neutral zero flow position.

It is another object of this invention to provide an unloading control of a load responsive bypass type pump control, which is responsive to electrically or hydraulically transmitted control signals to the direction control valves of the system below a certain specific minimum energy level of those control signals.

It is another object of this invention to provide an unloading control of a load responsive bypass type pump control in a system using multiple direction control valves controlling multiple loads and provided with a logic module, operable to selectively transmit control signals used, in the control of the direction control valves of the system, to the unloading control.

Briefly the foregoing and other additional objects and advantages of this invention are accomplished by providing a novel unloading control of a load responsive pump control, which permits unloading of the pump discharge pressure virtually to atmospheric level, without affecting the response of the system controls and which automatically deactivate the pump unloading control, before the direction control spools of the system valves are displaced from their neutral position, providing a feature of anticipation whereby the pump control is fully activated before the load controlling action can begin.

Additional objects of this invention will become apparent when referring to the preferred embodiments of this invention as shown in the accompanying drawings and described in the following detailed description.

DESCRIPTION OF THE PREFERRED EMBODIMENTS

Figure 1:
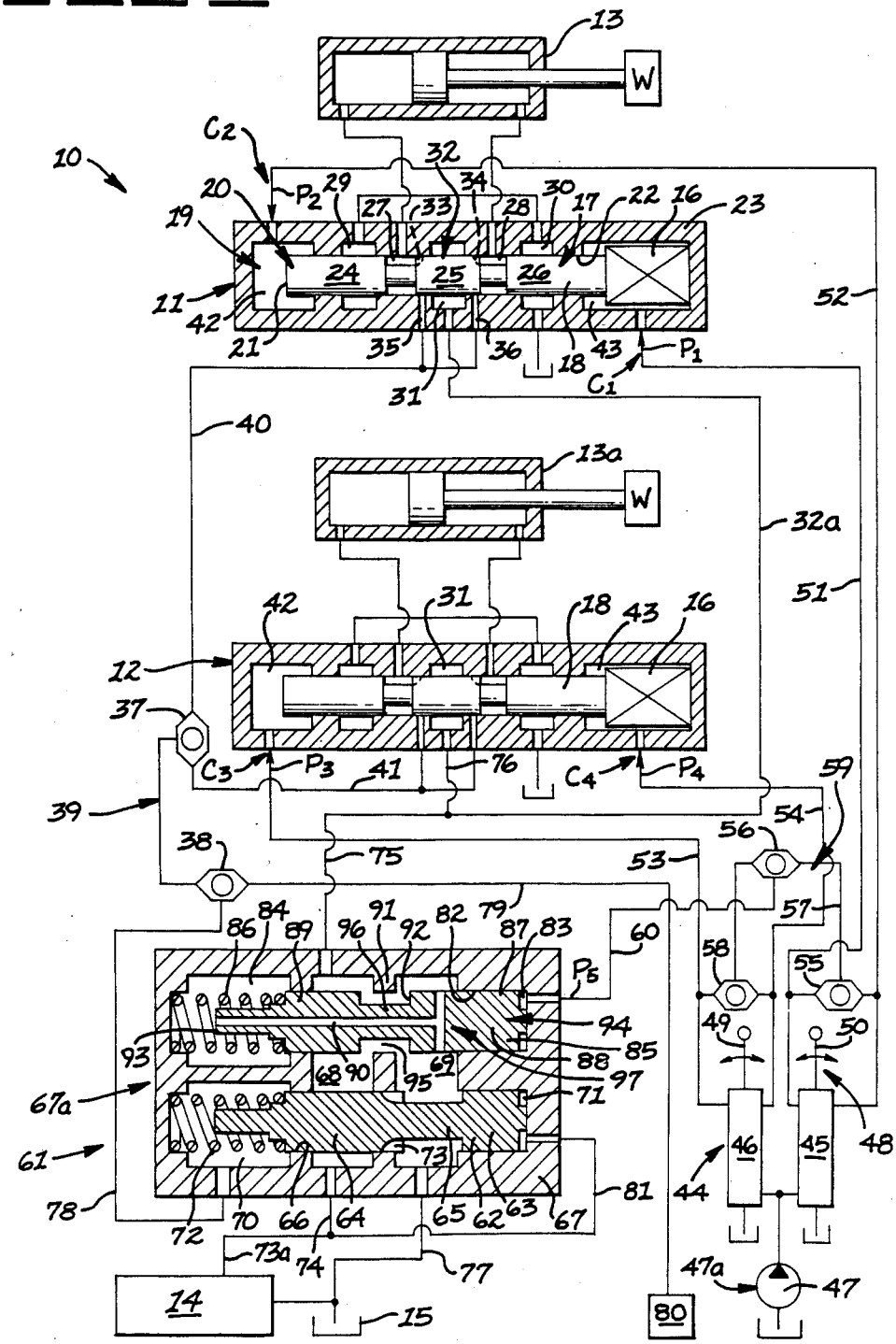
FIG. 1 is a longitudinal sectional view of two direction control valve assemblies, together with a sectional view of pump bypass control, provided with one type of unloading control, with system pump, reservoir, signal generators, power transmitting lines and signal transmitting lines shown schematically.

Referring now to the drawings and for the present to FIG. 1, direction and flow control valve means 10 include identical direction and flow control valves 11 and 12.

The direction and flow control valve 11 is interposed between an actuator 13 subjected to load W and a system pump 14 and reservoir means 15. The direction and flow control valve 11 is provided with spring biasing means 16 operable to bias spool means 17, which include a direction and flow control spool 18, towards its neutral flow isolating position. The direction and flow control valve 11 is also provided with first actuating means 19 including first force generating means 20, subjected to control signal generally designated as Cl and C2, which in the embodiment of FIG. 1 consists of force generated by hydraulic pressure of signals Pl, P2, P3 and P4, acting on the cross-sectional area 21 of the direction and flow control spool 18. The direction and flow control spool 18 of the direction and flow control valve 11, axially guided in a bore 22 of a housing 23 and provided with lands 24, 25 and 26, which define load chambers 27 and 28, is operationally connected to spring biasing means 16. The housing 23 is provided with exhaust chambers 29 and 30 connected to reservoir means 15 and a supply chamber 31 connected through supply line 32*a* with the system pump 14. The land 25 of the direction and flow control spool 18 is provided with inflow metering orifice means 32, which includes metering slots 33 and 34. The land 25 also selectively interconnects the load chambers 27 and 28 with load pressure sensing ports 35 and 36, which, together with shuttle valves 37 and 38, constitute load pressure signal shuttle logic means 39, well known in the art. The load sensing ports 35 and 36 of the direction and flow control valve 11 are connected with identical load sensing ports of the direction and flow control valve 12 to the shuttle valve 37 by lines 40 and 41. The land 24 of the direction and flow control spool 18 protrudes into a control chamber 42, while the land 26 protrudes into a control chamber 43.

Control signal generating means 44 include first control signal generator 45, second control signal generator 46, a source of energy 47*a*, which in the embodiment of FIG. 1 includes second pump means 47 and means responsive to an external control signal 48 including control levers 49 and 50.

The first control signal generator 45 is connected by signal line 51, transmitting a control pressure signal Pl, to the control chamber 43, while also being connected by signal line 52, transmitting a control pressure signal P2, to the control chamber 42. In a similar way the second control signal generator 46 is connected by signal lines 53 and 54, which transmit P3 and P4 control pressure signals, to the control chambers 42 and 43 of the direction and flow control valve 12.

A shuttle valve 55, interposed between signal lines 51 and 52 is connected to a shuttle valve 56 by a line 57. In an identical way a shuttle valve 58 is interposed between signal lines 53 and 54 and is connected to the shuttle valve 56. The shuttle valves 55,56 and 58 in the embodiment of FIG. 1 constitute control signal logic means 59, which, in its fluid power form, in a well known manner, is operable to transmit the highest of the control pressure signals P1, P2, P3 or P4 to line 60 connected to the shuttle valve 56.

Bypass throttling means 61 is interposed between supply chambers 31 of direction and flow control valve 11 and 12, the system pump 14 and reservoir means 15 and is operable to maintain a relatively constant control pressure differential between discharge pressure of said system pump 14 and pressure upstream of said inflow metering orifice means 32. Bypass throttling means 61 includes a throttling and bypass spool 62, provided with lands 63 and 64, which are connected by a stem 65 and are slidably guided in bore 66 in a housing 67. The housing 67 is provided with an inlet chamber 68, an exhaust chamber 69, a load pressure chamber 70 and discharge pressure chamber 71, all of said chambers being interconnected by the bore 66. The throttling and bypass spool 62 protrudes with the land 64 into the load pressure chamber 70 and with land 63 into the discharge pressure chamber 71 and is biased towards position as shown in FIG. 1 by a control spring 72. The land 64 is provided with throttling ports 73, which are operable to selectively interconnect the inlet chamber 68 with the exhaust chamber 69. The inlet chamber 68 is connected through lines 73*a* and 74 with the system pump 14, while also being connected through lines 75 and 76 with the supply chambers 31 of the direction and flow control valves 11 and 12. The exhaust chamber 69 is connected by line 77 to reservoir means 15. The load pressure chamber 70 is connected by line 78 to load signal shuttle logic means 39. The shuttle valve 38 may be a part of load signal shuttle logic means 39 and may be connected by line 79 to a separate schematically shown load pressure sensing system 80. The discharge pressure chamber 71 is connected by lines 81 and 74 with the inlet chamber 68.

The housing 67 also includes a bore 82 which interconnects the inlet chamber 68, the exhaust chamber 69, an unloading chamber 83 and an exhaust chamber 84 and slidably guides an unloading spool 85, biased towards position as shown by an unloading spring 86, which is located in the exhaust chamber 84. The unloading spool 85 is provided with a land 87, which protrudes into the unloading chamber 83 and is provided with a cross-sectional area 88, which also being provided with a land 89, which protrudes into the exhaust chamber 84. The exhaust chambers 69 and 84 are interconnected by passage 90, provided in the unloading spool 85. A web 91 intersected by bore 82 is positioned between the inlet chamber 68 and the exhaust chamber 69 and is selectively engageable by cut-off surface 92 provided on the land 87. The unloading spool 85 is also provided with a stop 93. The unloading chamber 83 is subjected to the actuating pressure P5, which is supplied by line 60 from control signal logic means 59. Deactivating means 94, in the configuration of FIG. 1, includes the unloading spool 85, which is operable to selectively open annular space 95, defined by a stem 96 and bore 82, which interconnects the inlet chamber 68 and the exhaust chamber 69 and constitutes connecting means 95. Deactivating means 94 is provided with second force generating means 97, which in FIG. 1 includes force generated on the cross-sectional area 88 by P5 pressure and opposed by the biasing force of the unloading spring 86. The housing 67 includes assembly of throttling and bypass spool 62 and unloading spool 85, both of those assemblies being generally designated a control assembly 67*a*.

Figure 2:
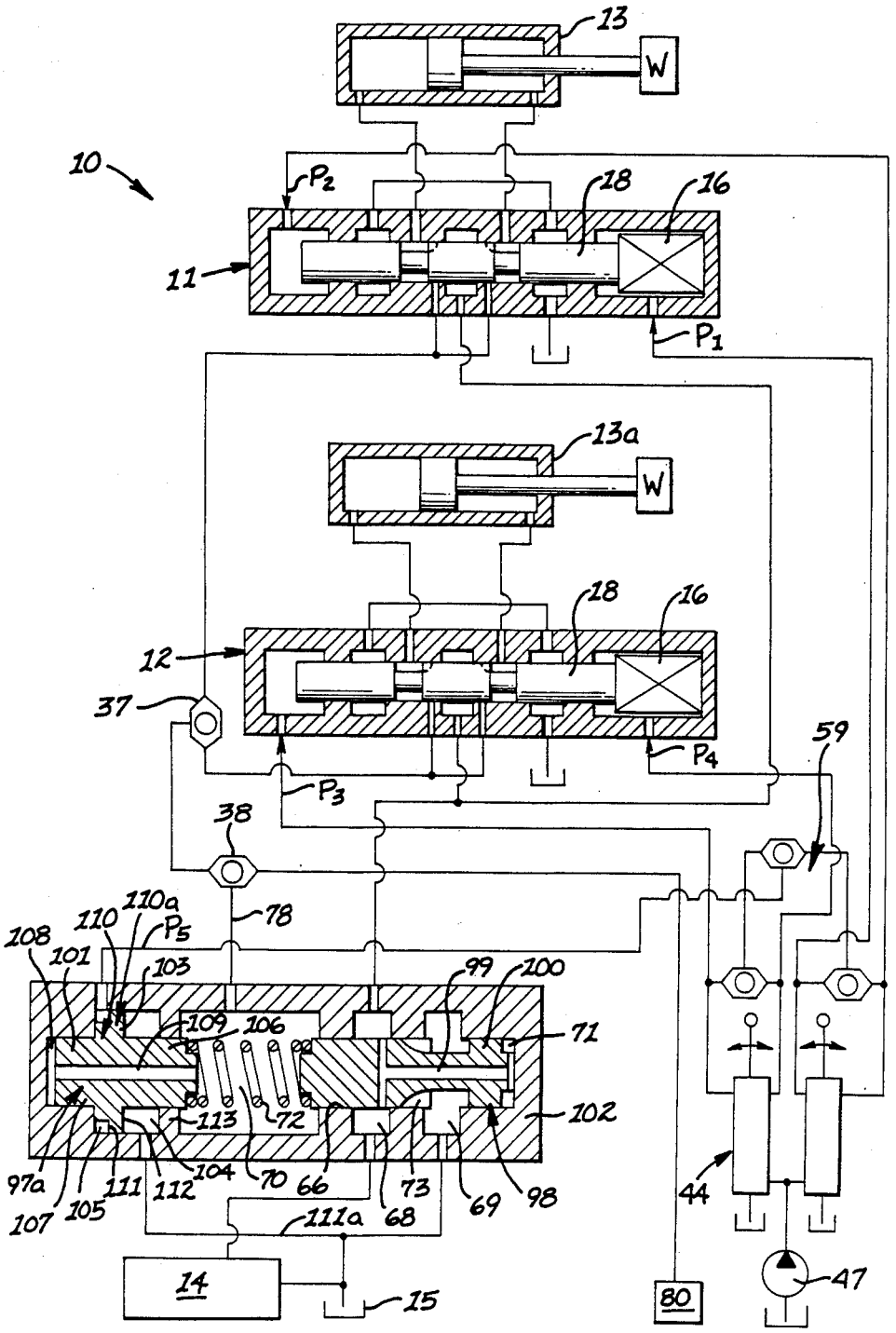
FIG. 2 is a longitudinal sectional view of two direction control valve assemblies together with a sectional view of pump bypass control provided with another type of unloading control with system pump, reservoir, signal generators, power transmitting lines and signal transmitting lines shown schematically.

Referring now to FIG. 2, like components are designated by like numerals. The basic control components, including the direction and flow control valves 11 and 12, control signal logic means 59, the pump 14, the reservoir 15 and control signal generating means 44 of FIG. 2 are identical to those of FIG. 1. Bypass throttling means 98 are functionally identical to bypass throttling means 61 of FIG. 1 with passage 99 in the throttling and bypass spool 100 of FIG. 2 being equivalent to line 81 of FIG. 1. The throttling and bypass spool 100 and a force piston 101 are slidably guided in bore 66 provided in a housing 102. A land 103 of the force piston 101 defines chambers 104 and 105. The force piston 101 protrudes with its circular extension 106 into the load pressure chamber 70, engaging the control spring 72, while also protruding with a circular extension 107 into a chamber 108, which is connected by passage 109 in the force piston 101 with the load pressure chamber 70. Deactivating means 110 of FIG. 2 accomplishes the same end results as deactivating means 94 of FIG. 1, but in the embodiment of FIG. 2 includes the force generating piston 101, operable to change the biasing force of the control spring 72. Second force generating means 97*a* of the embodiment of FIG. 2 includes force generated on the annular area 111 of the land 1023 of the force piston 101 by P5 pressure, opposed by the biasing force of the control spring 72. The land 103 of the force piston 101 is provided with surface 112 selectively engaging a rib 113, provided in the housing 102 and line 111*a* connects chamber 104 to the exhaust means 15. Second force generating means 97*a* is included in deactivating means 110, which also is provided with pressure differential reducing means 110*a*, operable to increase the biasing force of said control spring 72.

Figure 3:
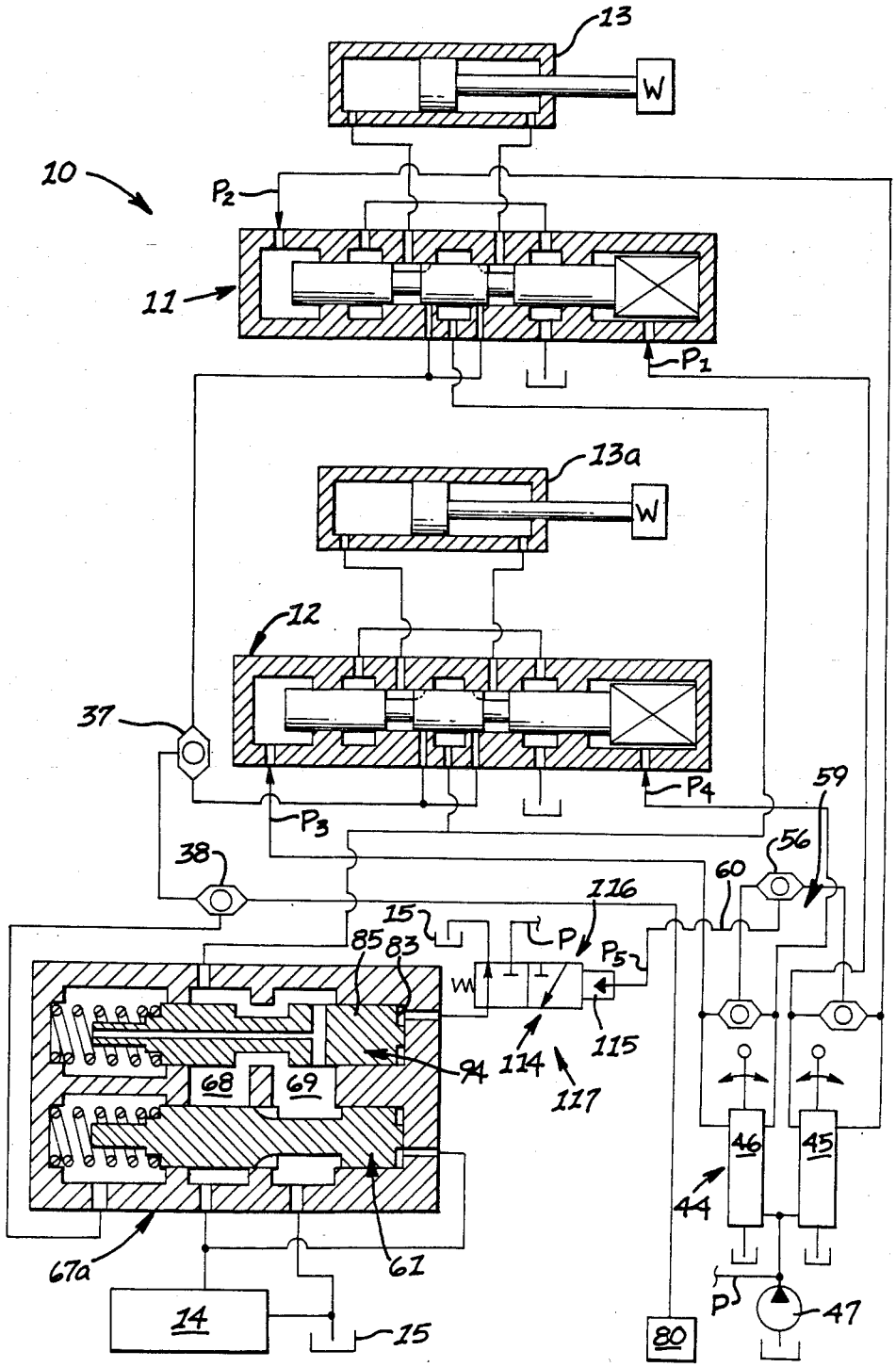
FIG. 3 shows identical system components as those of FIG. 1, with schematically shown hydraulic signal amplifying valve interposed between the hydraulic control signal generating system and the unloading control.

Referring now to FIG. 3, like components are designated by like numerals. The basic circuit components namely direction and flow control valves 11 and 12, control signal logic means 59, control signal generating means 44 and control assembly 67*a* of FIG. 3 are identical to those of FIG. 1. The only difference between FIGS. 1 and 3 is that in FIG. 3 a three way valve assembly 114, well known in the art, is interposed between the shuttle valve 56 and the control assembly 67*a* for selectively interconnecting, in response to P5 pressure, the second pump means 47 and the unloading chamber 83. The three way valve assembly 114 is provided with means 115 responsive to P5 pressure and constitutes power amplifying valve means 116. The three way valve assembly 114 in a well known manner is connected to second pump means 47 and reservoir means 15 and constitutes the interconnecting means 117.

Figure 4:
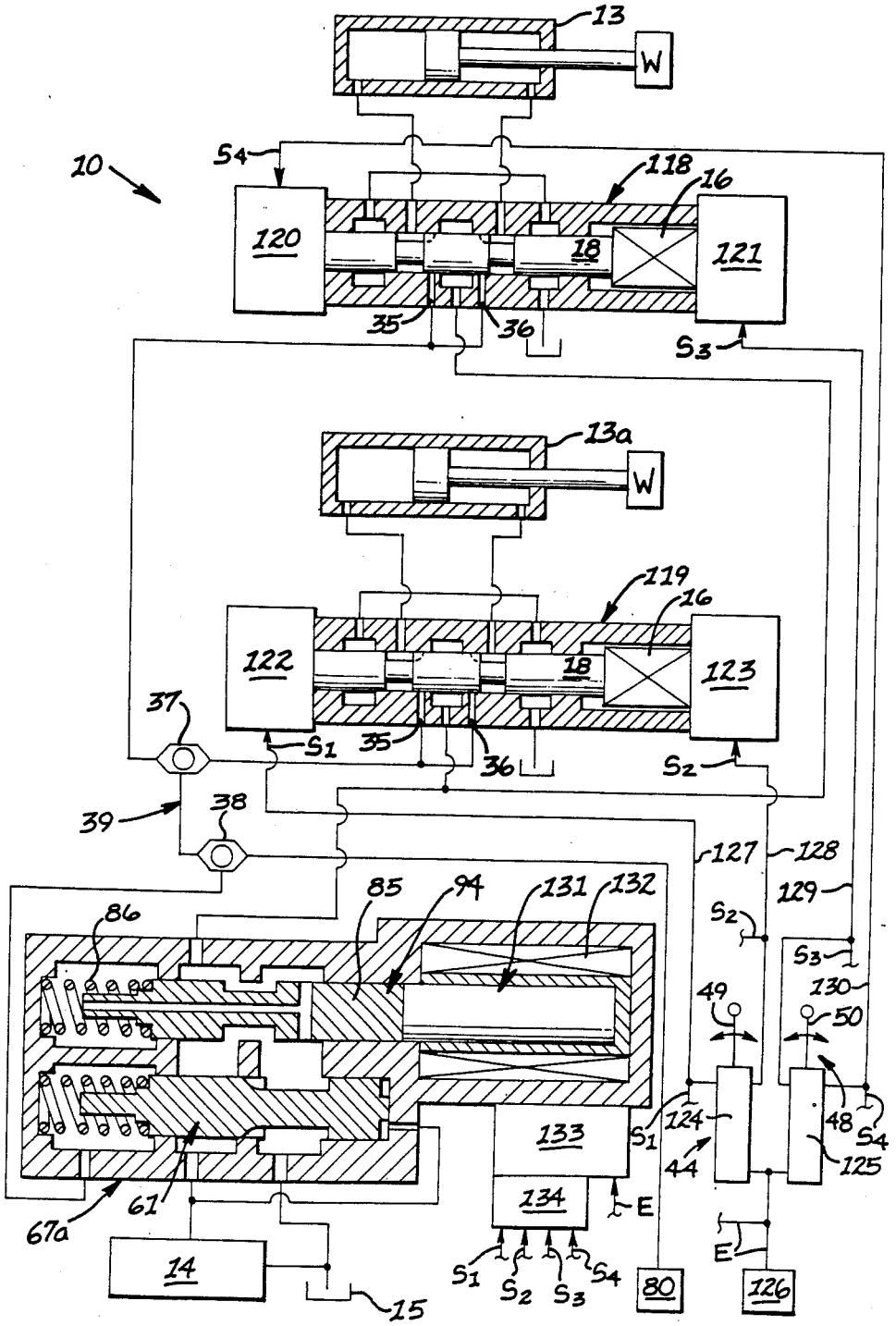
FIG. 4 is a longitudinal sectional view of two solenoid controlled direction control valve assemblies together with a sectional view of the pump bypass control and electrically solenoid operated unloading control, with system pump electrical control signal generating controls, fluid transmitting lines and electric signal transmitting lines shown schematically.

Referring now to FIG. 4, like components are designated by like numerals. Direction and flow control valves 118 and 119 are identical and perform in an identical way to control the fluid power as the direction and flow control valves 11 and 12 of FIG. 1. However, direction and flow control valves 118 and 119 are provided with direction and flow control spools 18 directly operated by proportional solenoids 120, 121, 122 and 123, which, in a well known manner, provide a mechanical displacement proportional to the energy of the electrical input signals S1, S2, S3 and S4. The electrical input or control signals S1, S2, S3 and S4 are generated by control signal generating means 44, which in the embodiment of FIG. 4 include first electrical signal generator 124 and second electrical signal generator 125, which are provided with control levers 49 and 50, which together constitute means responsive to an external control signal 48. The electrical signal generators 124 and 125, in a well known manner, are supplied with energy from the source of electrical power 126. First electrical signal generator 124 is connected by electrical signal transmitting lines 127 and 128 with proportional solenoids 122 and 123, while the second electrical generator 125 is connected by electrical signal transmitting lines 129 and 130 with the proportional solenoids 120 and 121. The basic configuration of the control assembly 67*a* of FIG. 4 is similar to that of FIGS. 1 and 3 the only difference being that the unloading spool 85 is directly operated by an electrical solenoid 131, well known in the art. The solenoid 131 is provided with a coil 132, provided with electrical power from the source of electrical power 126 through a relay 133, well known in the art. The relay 133, in a well known manner, in response to an electrical signal from electric logic 134, either connects or disconnects the coil 132 of the electrical solenoid 131 from the source of electrical power 126. In the embodiment of FIG. 4 in the presence of S1, S2, S3 or S4 electrical signals the electrical relay 133 connects the coil 132 with the source of electrical power 126, resulting in displacement of the unloading spool 85 against the biasing force of the unloading spring 86.

Figure 5:
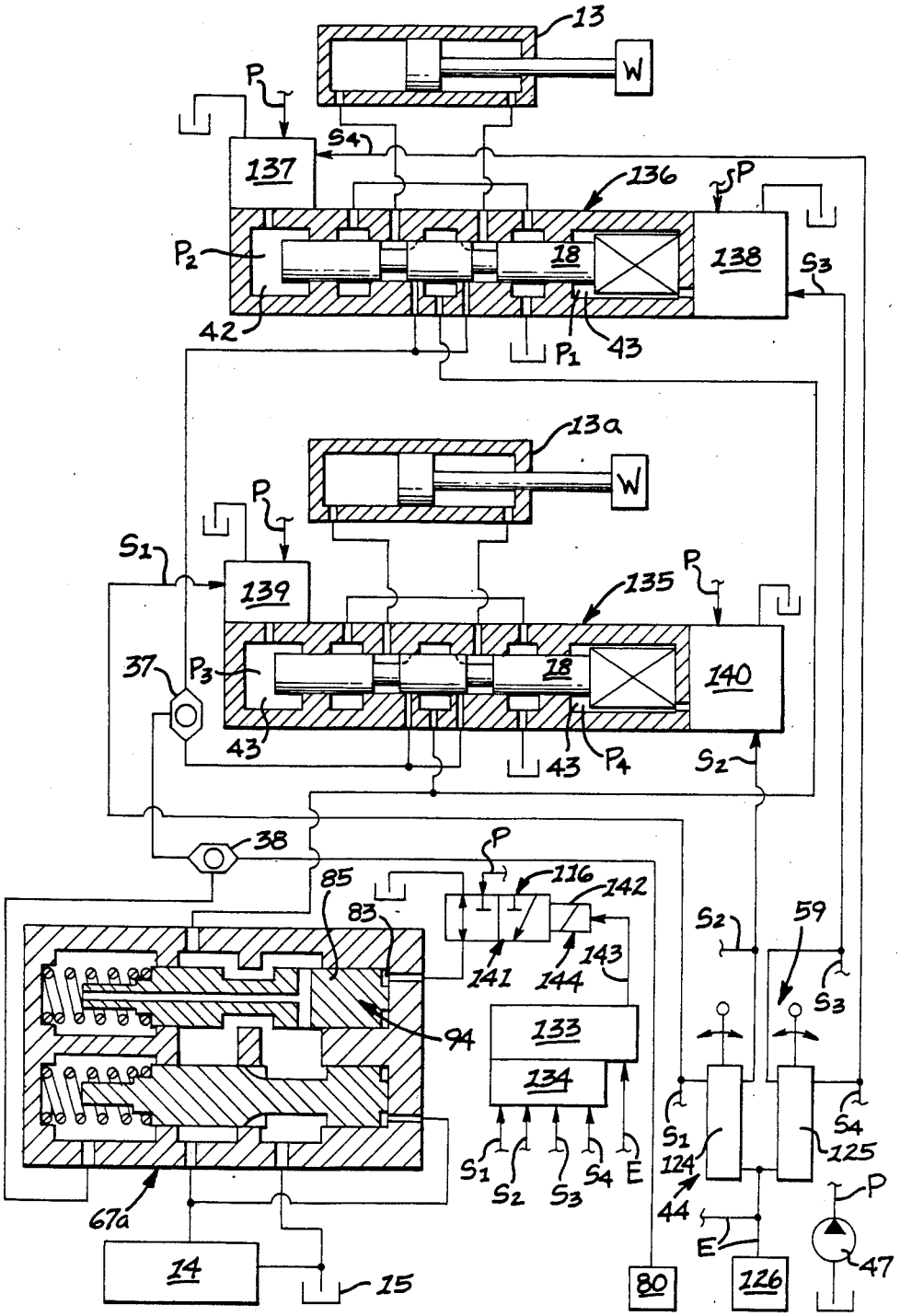
FIG. 5 is a longitudinal sectional view of two direction control valve assemblies provided with electro-hydraulic controls together with a sectional view of pump bypass control and hydraulic operated unloading control with electrical signal generating control, power amplifying valve responsive to an electrical control signal, system pump, separate control pump, fluid transmitting lines and electrical signal transmitting lines shown schematically.

Referring now to FIG. 5, like components are designated by like numerals. The direction control spools 18 of the direction and flow control valves 135 and 136 are displaced in a manner identical to that as referred to in FIG. 1 by control pressures generated by electrohydraulic valves 137, 138, 139 and 140, well known in the art, which in response to electrical control signals S1, S2, S3 and S4 will produce proportional pressure signals P1, P2, P3 and P4 in the control chambers 42 and 43. In a manner similar to that as shown in FIG. 3, the power amplifying valve means 116 is interposed between electric logic means 134 and deactivating means 94 of the control assembly 67*a*. Power amplifying valve means 116 is provided with a three way valve 141, well known in the art, which will, in a well known manner, connect unloading chamber 83 with a source of hydraulic power 47, when actuated by a solenoid 142 supplied with an electrical power signal 143. The solenoid 142, responding to electrical power signal 143 constitutes the means 144, responsive to electrical signal from electric logic 134.

Referring now back to FIG. 1, a fluid power and control system of this invention is interposed between the system pump 14 and system actuators 13 and 13*a* controlling load W. The control system of FIG. 1 will control a single actuator, while also being adaptable to the control of multiple actuators, when using a single system pump.

The direction and flow control valves 11 and 12 of the system are of a conventional type, well known in the art, and are provided with metering slots 33 and 34 and load pressure sensing ports 35 and 36, which are connected through a logic system of shuttle valves 37 and 38 to the bypass and throttling means 61, well known in the art.

The direction and flow control spools 18 of the direction and flow control valve 11 and 12 are displaced against the centering force of spring biasing means 16 by control signals, remotely generated by control signal generating means 44 and in a well known manner, in a proportional way, vary the flow area of the metering slots 33 and 34, while also transmitting the load pressure signals to the throttling and bypass spool 62.

In a well known manner the throttling and bypass spool 62, subjected to pump discharge pressure in chamber 71 and positive load pressure, transmitted through the load pressure sensing and logic circuit, to the load pressure chamber 70, while also being subjected to the biasing force of the control spring 72, will assume a modulating position throttling through throttling ports 73 fluid flow from the inlet chamber 68 to the exhaust chamber 69, to maintain a relatively constant pressure differential between the pump discharge pressure and the highest positive load system pressure, this pressure differential being equivalent to the preload in the control spring 72.

In the system of FIG. 1, since while controlling any of the system loads, with constant pressure differential being automatically maintained constant across the metering slots 33 and 34, by the bypass throttling means 61, the fluid flow into the fluid motor 13 or 13*a* will become proportional to the displacement of the valve spool 18, irrespective of the magnitude of the system load W. Since, as previously described, the displacement of the direction and flow control spool 18 is in turn proportional to the magnitude of the control signal, generated by the control signal generating means 44, very precise control of the load W can be obtained.

As is well known in the art, one of the basic characteristics of bypass throttling means 61 is that in the absence of a load pressure signal and therefore in standby condition it will generate and maintain a minimum discharge pressure of the pump 14, which is equivalent to the preload of the control spring 72, which minimum system pressure, in conventional operating systems, usually exceeds 100 PSI, which especially in a system utilizing the system pump 14 of a large size represents a large parasitic loss, associated with such control systems.

In the embodiment of FIG. 1 in the absence of P5 control pressure, the unloading spool 85, subjected to the biasing force of the unloading spring 86 will be maintained in position as shown in FIG. 1, providing a bypass path for fluid flow through annular space 95, from the inlet chamber 68 to the exhaust chamber 69, maintaining, in standby condition, the discharge pressure of pump 14 at near atmospheric level and therefore maintaining the system losses in a standby condition to a minimum level.

With control pressure P5 provided to unloading chamber 83 at a level high enough to generate force, to overcome the preload of the unloading spring 86, the unloading spool 85 is moved all the way from right to left with the cut-off surface 92, in combination with web 91, isolating the inlet chamber 68 from the exhaust chamber 69. Under those conditions the bypass throttling means 61 will automatically assume its modulating position, maintaining, in a manner as previously described, the discharge pressure of the pump 14 at a constant level, equivalent to the preload of the control spring 72 and equal to the control pressure differential of the load responsive system.

In the embodiment of FIG. 1 the control pressure signals P1, P2, P3 and P4 are generated by the first and second control signal generators 45 and 46, using energy derived from source of energy 47*a*, which in this embodiment is second pump means 47.

The generated control pressure signal P1, P2, P3 or P4 reacts on the cross-sectional area of the direction and flow control spool 18 and will start displacing it in either direction at a pressure level equivalent to the centering force of the spring biasing means 16. Therefore, until a specific level of the control pressure, as dictated by the centering force of the spring biasing means 16, is reached, the direction and flow control spools 18 will remain in the centered position, as shown in FIG. 1, isolating inlets and outlets of the actuators 13 or 13*a*. However, the very fact that the control pressure signal is generated by the first or second control signal generators 45 or 46, automatically establishes the intention of the operator to control the load W.

The P5 pressure level, to fully actuate the unloading spool 85, is selected well below the minimum pressure level of the control pressures P1, P2, P3 and P4, which would displace the direction control spools 18.

The first and second control signal generators 45 and 46, which in the embodiment of FIG. 1 are of a hydraulic type, are connected by fluid conducting lines 51, 52, 53 and 54 to the direction and flow control valves 11 and 12 respectively, while control signal logic means 59, including the shuttle valves 55, 56 and 58, connect by line 60 the highest of the control pressures p1, p2, p3 or p4 to the unloading chamber 83. To facilitate the description of the operation of FIG. 1 the maximum load pressure signal generated by control signal generating means 44 and transmitted by the control signal logic means 59 to the unloading chamber 83, is denoted as P5.

Therefore, at any preselected P5 pressure level of P1, P2, P3 and P4 control pressures, which is selected well below the control pressure level, capable of actuating the direction and flow control spools 18, through the action of unloading spool 88, the load responsive circuit of FIG. 1 is activated, in anticipation of controlling action of load W, while the direction and flow control spools 18 remain in neutral position isolating the port of fluid motors 13 and 13*a*.

Any further increase in the pressure level of the signals P1, P2, P3 and P4, above that equivalent to that of the spool centering forces, will displace the spools 18 in either direction, with the fully activated load responsive system control automatically providing a well known proportional control feature of system loads.

Any reduction in control pressure signals to P5 level will first permit spring biasing means 16 to return the direction and flow control spools 18 to their neutral isolating position, while also permitting after this sequence of events is accomplished, movement of the unloading spool 85 under action of the unloading spring 86 to its fully bypass position, as shown in FIG. 1, thus lowering the pump discharge pressure to a minimum level.

Therefore, the embodiment of FIG. 1 permits unloading of the system for a minimum system loss in standby condition, while also providing activation of the load responsive system controls, before the direction control spools of the system are displaced and therefore before the control action of the system loads can take place, providing a unique anticipation feature, high system response and minimum system loss in bypass condition.

Referring now back to FIG. 2, identical direction and flow control valves 11 and 12 are provided with an identical load sensing system, control signal generating means 44 and control signal logic means 55 as used in FIGS. 1 and 2. As described when referring to FIG. 1 bypass throttling means 98 performs an identical function as the bypass throttling means 61 of FIG. 1, in maintaining a constant pressure differential between the inlet chamber 68 and the load pressure signal, by the throttling and bypassing action of the throttling ports 73. In a well known manner this constant pressure differential is proportional to the preload in the control spring 72.

However, in the arrangement of FIG. 2, in standby condition, in a manner well known in the art, the preload in control spring 72 is reduced to a certain preselected minimum level, which automatically reduces the control pressure differential and the pump discharge pressure in standby condition, thus substantially reducing the parasitic system loss in standby condition. In the systems of prior art this minimum pressure level and minimum pressure differential, in standby condition, can be reduced only to a certain minimum level, since the minimum pump discharge pressure, in standby condition, must be sufficiently high to self-energize the control circuit. With such a control not only the system loss, although substantially reduced, is still comparatively high, but because of the low energy levels, used in energizing the control system, the response of the energizing controls is very slow.

In the present invention with the force piston 101, in the position as shown in FIG. 2, the preload in the control spring 72 is completely eliminated and the bypass and throttling spool 100 moves to the left, interconnecting the inlet chamber 68 with the exhaust chamber 69 through a very large flow area of the throttling port 73. In this way, in standby condition the pump discharge pressure can be reduced to a very low level, corresponding to a very small system loss. The force piston 101 is provided with two circular extensions 106 and 107, having identical cross-sectional areas, with passage 109 interconnecting the chamber 108 with the load pressure chamber 70, providing a balanced type configuration of the force piston, which does not respond to the pressure level of the positive load pressure existing in the load pressure chamber 70. With the chamber 104 connected by line 111a to the system reservoir 15, any pressure in the chamber 105 generates, in a well known manner, a force equal to the product of the pressure and the annular area 111. This annular area 111 is so selected that when subjected to P5 pressure it will move the force piston 101 all the way from left to right through a preselected distance, which will produce a preselected preload in the control spring 72, equivalent to the relatively constant control pressure differential of the load responsive system. Therefore, in a different way the embodiment of FIG. 2 produces identical control characteristics as that of the embodiment of FIG. 1.

In the absence of P5 pressure, or with P5 pressure below a certain specific preselected level, the control of the pressure differential of the system is deactivated and the discharge pressure of the pump 14 is brought to a minimum level, corresponding to a minimum standby loss.

In a manner as fully described when referring to FIG. 1, the presence of control signals p1, p2, P3 and p4 at P5 pressure level Will energize, through the control signal logic means 59, the pressure differential reducing means 110a, automatically restoring the constant pressure differential control action of bypass throttling means 98. Therefore, the system load responsive control becomes activated before the direction and flow control spools 18 are displaced from their neutral position, providing an anticipation feature identical to that of FIG. 1. The activation of the control of the constant pressure differential takes place through control signal logic means 59, using the energy derived from second pump means 47, permitting the pump 14 to work at minimum pressure level in its standby condition.

While controlling the load W reduction of the pressure of the control pressure signals P1, P2, P3 and P4, to a level equivalent to the centering force of the spring biasing means 16, permits the return of the direction control spools 18 to their neutral isolating position, while the load sensing control is still active. A further reduction in control pressure to or below the P5 pressure level automatically signifies the intention of the operator to discontinue control of the load W and also signifies standby condition. In a manner as described when referring to FIG. 1, a drop in control pressure signal below P5 pressure level automatically unloads the system pump 14 to a minimum standby discharge pressure level.

Referring now back to FIG. 3, all of the basic control components of FIG. 1 are identical to those of FIG. 3 and perform in an identical way. The only difference between FIG. 1 and FIG. 3 is the introduction of power amplifying valve mans 116 in the form of well known three way valve assembly 14, which is interposed between the shuttle valve 56 and the unloading chamber 83. The three way valve 114 is provided with means responsive to P5 pressure 115, which is in the form of a hydraulic actuator spring, biased towards position as shown in FIG. 3. In this position the unloading chamber 83 is directly connected to reservoir 15 and the deactivating means 94 automatically unloads the discharge pressure of the pump 14 to near atmospheric level, in a manner as described in detail when referring to FIG. 1.

Once control signal generating means 44 generates a control signal at a pressure level equal to or exceeding P5 pressure, in a well known manner the three way valve 114 is moved into a position, in which P pressure of second pump means 47 is directly connected to the unloading chamber 83. The presence of high pressure in the unloading chamber 83, in a manner as described when referring to FIG. 1, moves the unloading spool 85 from right to left, isolating the inlet chamber 68 from the exhaust chamber 69 and therefore automatically activating the load responsive constant pressure differential control—bypass throttling means 61.

Once control signal generating means 44 generates a control signal at a pressure level equal to or exceeding P5 pressure, in a well known manner the three way valve 114 is moved into a position, in which P pressure of second pump means 47 is directly connected to the unloading chamber 83. The presence of high pressure in the unloading chamber 83, in a manner as described when referring to FIG. 1, moves the unloading spool 85 from right to left, isolating the inlet chamber 68 from the exhaust chamber 69 and therefore automatically activating the load responsive constant pressure differential control—bypass throttling means 61.

Although the basic operation of the control circuits of FIGS. 1 and 3 are identical, there is a difference in response of the unloading control between the embodiments of FIGS. 1 and 3.

In FIG. 1 the energy of the control pressure signal P1, P2, P3 or P4 is used to displace the unloading spool 85. This requires larger capacity signal generators 45 and 46 and larger capacity control signal logic means and slows down significantly the response of the control.

In FIG. 3, through the use of power amplifying valve means 116, which responds to pressure at minimum flow, permits direct use of the energy developed by second pump means 47 in displacement of the unloading spool 85, not only significantly reducing the required flow capacity of the signal generators 45 and 46 and flow transmitting capacity of the control signal logic means 59, but results in a much faster responding controls, which is still provided with the feature of anticipation.

Referring now back to FIG. 4 the direction and flow control valves 118 and 119, as far as the fluid power and transmission circuit are concerned, are identical to direction and flow control valves 11 and 12 of FIG. 1. The only difference between direction and flow controls 118 and 119 of FIG. 4 as compared to those of FIG. 1 is in the way in which the direction control spools 18 are displaced, in response to the control signals S1, S2, S3 and S4. The direction and flow control spools 18 of FIG. 4 are spring biased by spring biasing means 16, towards neutral position and displaced from neutral position by the proportional solenoids 120, 121, 122 and 123, well known in the art, which are supplied with electrical control signals S1, S2, S3 and S4, from control signal generating means 44, which, in the embodiment of FIG. 4, consists of electrical signal generators 124 and 125, well known in the art, and supplied with electrical energy from the source of electrical power 126. The electrical signal generators 124 and 125 generate electrical control signals in response to the displacement of the control levers 49 and 50. Although the electrical control signals S1, S2, S3 and S4 can be proportional to the displacement of the control levers 49 and 50, in either direction from their neutral position, as is well known in the art, those signals can be conditioned to include the solenoid temperature compensation and may include the so-called spring bias eliminator which, with the control levers 49 and 50 displaced from neutral position, generate an electrical signal at an energy level equivalent to the preload of the centering spring biasing means 16.

The hydraulic circuits of FIGS. 1 and 4, including direction control valves 118 and 119, the load shuttle logic means 39, which may include load pressure sensing ports 35 and 36 and the control assembly 67*a*, including the bypass throttling means 61 and the unloading spool 85 are identical, the one basic difference between FIGS. 1 and 4 is in generation of the electrical signals S1, S2, S3 and S4 versus hydraulic pressure control signals P1, P2, P3 and P4 and the displacement mechanism of the spool 85. In FIG. 4 the unloading spool 85 is displaced by the armature of the electrical solenoid 131, contained within the coil 132. The solenoid 131 is provided with energy from the source of electrical power 126, through an electrical relay 133, which is activated by a signal from electric logic 134, in response to electrical signals S1, S2, S3 and S4, generated by the electrical signal generators 124 and 125.

The electrical solenoid 131 of FIG. 4, from a functional standpoint, is equivalent to the second force generating means 97 of FIG. 1, while the electrical signal generators 124 and 125 of control signal generating means 44 of FIG. 4, are equivalent to the control signal generators 45 and 46 of FIG. 1, all of those generators being responsive to the displacement of the control levers 49 and 50, while the control signal logic means 59 are equivalent to the electric logic 134 combined with electrical relay 133.

In a manner as described when referring to FIG. 1, in standby condition the system pump 14 is fully unloaded by the unloading spool 85.

Generation of an electrical control signal at a first power level, through the electric logic 134 and the relay 133, actuates the unloading spool 85 by the solenoid 131, in a manner as previously described, activating the bypass throttling means 61, while the proportional solenoids 120, 121, 122 and 123 generate a force, lower than that equivalent to the centering force of the spring biasing means 16, with the direction control spools 18 remaining in their load isolating position.

Further increase in the power level of the electrical control signals S1, S2, S3 and S4 proportionally displaces, through the proportional solenoids 120, 121, 122 and 123, the valve spools 18 from their neutral position, proportionally controlling the velocities of the load W, irrespective of the magnitude of the load. The control aspects of the load responsive control of FIG. 4, from a fluid power standpoint, were fully described when referring to FIG. 1 and the control characteristics, advantages and the features of anticipation are retained in both of those controls.

Referring now back to FIG. 5, the control characteristics of the direction and flow control valves 135 and 136 are identical to the direction and flow control valves 118 and 119 of FIG. 4, the one difference being that instead of using the electrical proportional solenoids 120, 121, 122 and 123 of FIG. 4 the electro-hydraulic valves 137, 138, 139 and 140 are used. Both the proportional solenoids and the electro-hydraulic valves respond to the electrical control signals S1, S2, S3 and S4, generated by similar electric signal generators 124 and 125, which constitute control signal generating means 44. The embodiments of FIGS. 4 and 5 use similar electric logic 134 and relay 133, responsive to the electrical control signals S1, S2, S3 and S4.

The basic difference between the embodiments of FIGS. 4 and 5 is in actuation of the unloading spool 85. In FIG. 5 the unloading spool 85 is actuated in an identical way as the unloading spool 85 of FIG. 3, through the action of power amplifying valve means 116, which include identical three way valves 114 and 141, the only difference between those three way valves being that the three way valve 114 of FIG. 3 has means responsive to P5 pressure 115 and is operated by hydraulic pressure, while the three way valve 141 of FIG. 5 is operated directly by solenoid 142, in response to an electrical power signal 143.

The embodiment of the control of FIG. 5 has much faster response characteristics, since the response of the electro-hydraulic valves 137, 138, 139 and 140 is much faster than the response of proportional electrical solenoids 120, 121, 122 and 123 of FIG. 4, but also the response of the unloading spool 85 of FIG. 5 is much faster than the solenoid operated version of FIG. 4, since, in a manner as described when referring to FIG. 3, it is utilizing the energy developed in the second pump means 47, to move the unloading spool 85.

All the basic control characteristics of FIGS. 1-5 are identical, with most of the same common advantages of saving energy and the feature of anticipation, when converting from standby condition to operational condition.

Although the preferred embodiments of this inventions have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

I claim:

1. A fluid power load responsive system comprising an actuator, a system pump, reservoir means and at least one direction and flow control valve means, said direction and flow control valve means having a variable inflow metering orifice means operably connected to said actuator, spring biasing means operable to bias said inflow metering orifice means towards a closed position and first actuating means having first force generating means responsive to a control signal and operable to vary the flow area of said inflow metering orifice means above a certain first predetermined energy level of said control signal, bypass throttling means operable to maintain a relatively constant control pressure differential between the discharge pressure of said system pump and pressure downstream of said inflow metering orifice means above said first predetermined energy level of said control signal, and deactivating means of said bypass throttling means having second force generating means responsive to said control signal and operable to deactivate said bypass throttling means below a certain second predetermined energy level of said control signal, said first predetermined energy level of said control signal being higher than said second predetermined energy level whereby discharge pressure of said system pump can be maintained below the level of said relatively constant pressure differential when said control signal drops below said second predetermined energy level.

2. A fluid power load responsive system as set forth in claim 1 wherein signal generating means includes a source of energy other than said system pump, and means responsive to an external control signal, said signal generating means operable to generate said control signal.

3. A fluid power load responsive system as set forth in claim 2 wherein said source of energy includes second pump means operable to provide said signal generating means with a source of control pressure other than said system pump.

4. A fluid power load responsive system as set forth in claim 2 wherein said source of energy includes electrical energy generating means.

5. A fluid power load responsive system as set forth in claim 1 wherein said deactivating means includes connecting means operable to directly interconnect said system pump and said reservoir means.

6. A fluid power load responsive system as set forth in claim 1 wherein said deactivating means has pressure differential reducing means operable to reduce the level of said relatively constant pressure differential to a minimum predetermined level.

7. A fluid power load responsive system as set forth in claim 1 wherein said direction and flow control valve means includes a spool means operably interconnected to said variable inflow metering orifice means, said spring biasing means and said first actuating means.

8. A fluid power load responsive system as set forth in claim 1 wherein said first force generating means includes means responsive to fluid pressure of said control signal.

9. A fluid power load responsive system as set forth in claim 1 wherein said first force generating means includes means responsive to electric current of said control signal.

10. A fluid power load responsive system as set forth in claim 1 wherein multiple direction and flow control valve means direct fluid flow to and from multiple actuators, multiple signal generating means each operably connected to specific direction and flow control valve means, and control signal logic means interposed between said multiple signal generating means and said deactivating means, said control signal logic means operable to transmit a control signal to said deactivating means in response to multiple control signals generated by said multiple signal generating means.

11. A fluid power load responsive system as set forth in claim 10 wherein said control signal logic means include fluid logic shuttle valve means operable to transmit the highest of said control signals from multiple signal generating means to deactivating means.

12. A fluid power load responsive system as set forth in claim 10 wherein said control signal logic means includes electric logic means operable to transmit a control signal to said deactivating means when any of said control signal generating means generates control signals above said second predetermined energy level.

13. A fluid power load responsive system as set forth in claim 10 wherein load signal shuttle logic means are interposed between said multiple direction and flow control valve means and said bypass throttling means.

14. A fluid power load responsive system as set forth in claim 1 wherein power amplifying valve means is interposed between said signal generating means and said deactivating means.

15. A fluid power load responsive system as set forth in claim 14 wherein said power amplifying valve means has means responsive to fluid pressure of said control signal and interconnecting means operable to selectively interconnect said deactivating means with second pump means.

16. A fluid power load responsive system as set forth in claim 14 wherein said power amplifying valve means has means responsive to electrical signal from electric logic means and has interconnecting means operable to selectively interconnect said deactivating means with second pump means.

17. A fluid power load responsive system as set forth in claim 1 wherein electro-hydraulic valve means is interposed between said signal generating means and said actuating means, said electro-hydraulic valve means operable to convert a signal from said signal generating means into proportional pressure signal.

18. A fluid power load responsive system as set forth in claim 1 wherein said first actuating means includes proportional solenoid means.

* * * * *